US005979467A

United States Patent [19]

Potut et al.

[11] Patent Number: 5,979,467

[45] Date of Patent: Nov. 9, 1999

[54] HAIR CLIP WITH PROFILED TEETH

[75] Inventors: Christian Potut; Jean-Francois Potut, both of Arbent, France

[73] Assignee: C.S.P. Diffusion, Societe Anonyme, Metz Tessy, France

[21] Appl. No.: 09/049,159

[22] Filed: Mar. 26, 1998

[30] Foreign Application Priority Data

Mar. 28, 1997 [FR] France ..... 97 04244

[51] Int. Cl.[6] ..... A45D 8/20; A45D 19/16; A45D 8/00; A45D 8/22

[52] U.S. Cl. ..... 132/277; 132/273; 132/276; 132/278; 132/279

[58] Field of Search ..... 132/277, 278, 132/279, 280; D28/32, 39, 40, 41, 42, 43

[56] References Cited

U.S. PATENT DOCUMENTS

| | | | |
|---|---|---|---|
| 3,120,852 | 2/1964 | Sawyer | 132/145 |
| 5,494,060 | 2/1996 | Potut | 132/277 |
| 5,549,127 | 8/1996 | Chang | 132/277 |
| 5,642,740 | 7/1997 | Chen | 132/277 |
| 5,664,591 | 9/1997 | Potut | 132/277 |
| 5,697,288 | 12/1997 | Chang | 132/277 |
| 5,735,296 | 4/1998 | Chen | 132/277 |

FOREIGN PATENT DOCUMENTS

| | | |
|---|---|---|
| 669088 | 8/1995 | European Pat. Off. . |
| 592049 | 7/1925 | France . |
| 755662 | 11/1933 | France . |
| 770805 | 9/1934 | France . |
| 1049705 | 12/1953 | France . |

*Primary Examiner*—John J. Wilson
*Assistant Examiner*—Robyn Doan
*Attorney, Agent, or Firm*—Ratner & Prestia

[57] ABSTRACT

A hair clip of the invention comprises two jaws hinged together by hinge means. At least some of the teeth are relatively narrow in the vicinity of their base and can have a maximal width in the central area of the tooth and be relatively narrow in the vicinity of the free end of the tooth. This improves the retention of the clip in the hair.

10 Claims, 2 Drawing Sheets

HAIR CLIP WITH PROFILED TEETH

BACKGROUND OF THE INVENTION

1. Field of the Invention

The present invention concerns hair clips such as are used by women's hairdressers, for example.

2. Description of the Prior Art

Prior art hair clips, such as those described for example in documents FR 770 805 A and FR 755 662 A and in patents U.S. Pat. No. 5,494,060 and U.S. Pat. No. 5,664,591, usually have a first jaw with a first series of generally parallel teeth, a second jaw with a second series of generally parallel teeth and hinge means connecting the first and second jaws and allowing them to pivot relative to each other about a hinge pin between an open configuration in which the first and the second series of teeth are moved apart and a closed configuration in which the first and second series of teeth are interleaved with each other.

In patents U.S. Pat. No. 5,494,060 A and U.S. Pat. No. 5,664,591 A the parallel teeth are curved in a circular arc shape and have a substantially constant and relatively small width along their entire-length.

In documents FR 770 805 A and FR 755 662 A the teeth have a triangular profile with a width that is maximal near their base and reduces progressively towards their free end.

As described in the above documents the hinge means connect the first and second jaws in their respective intermediate areas between two holding levers and the clamping areas provided with teeth and spring means urge the jaws to pivot relative to each other towards their closed configuration.

Other prior art hair clips or slides, as described for example in document FR 592 049 A, are hinged at one lateral end of the jaws and the teeth also have a triangular profile with a width which is maximal at the base of the teeth and decreases progressively towards their free end.

With hair clips like those of the prior art one useful function is to assure good retention in the hair and to hold as much hair as possible.

It is nevertheless found that retention in the hair is less than perfect, because locks of hair tend to slide progressively between the teeth and the hold loosens.

Document FR 1 049 705 A describes a clip with two hinged jaws for holding a looped lock of hair. The teeth of each jaw are connected together along their base by a median bar, the two median bars being adapted to grip the lock of hair and to hold it away from the scalp, allowing air to pass between the teeth on respective opposite sides of each median bar to dry the hair. The part of the teeth projecting beyond the corresponding median bar has a width that decreases towards the free end of the tooth. The teeth have a triangular profile. The open part inboard of the corresponding median bar does not exercise the function of a row of teeth because the bar prevents penetration into a mass of hair. In the closed configuration of the clip the projecting part of the teeth extends along a circular arc entirely in the direction of the opposite jaw.

The problem addressed by the present invention is that of improving the retention of the clip in the hair by preventing locks of hair slipping between the teeth of the clip, in particular slipping in the mean longitudinal direction of the teeth.

Another object of the invention is to improve the "hold", by which is meant to increase the amount of hair that a given size of clip is able to hold.

SUMMARY OF THE INVENTION

To achieve the above and other objects, a hair clip in accordance with the invention comprises a first jaw having a first series of generally parallel curved teeth, a second jaw having a second series of generally parallel curved teeth and hinge means connecting the first jaw and the second jaw allowing them to pivot relative to each other about a hinge pin between an open configuration in which the first series of teeth and the second series of teeth are moved apart and a closed configuration in which the teeth of the first series of teeth are interleaved with the teeth of the second series of teeth, wherein at least some of the teeth of the first series of teeth or of the second series of teeth are relatively narrow in the vicinity of their base.

In a preferred embodiment at least some of the teeth have a maximal width in the central area of the tooth and their width decreases in the direction of the base of the tooth and in the direction of a free end of the tooth.

Good results are achieved if at least some of the teeth have a width at their base and in the vicinity of their free end equal to at least three times their thickness and a width in their central area equal to at least four times their thickness.

The teeth can preferably have a curved longitudinal profile with a base area extending away from the other jaw and an end area extending towards the other jaw in a closed configuration of the clip.

The varying width teeth can advantageously have a median longitudinal slot.

In a closed position of the clip, the varying width teeth of the first series of teeth are preferably side-by-side with the varying width teeth of the second series of teeth in their central areas.

In a first embodiment the hinge means connect the first jaw and the second jaw in their respective intermediate areas between two holding levers and clamping areas with the first series of teeth and the second series of teeth constituting a hair clip with profiled teeth; spring means urge the jaws to pivot relative to each other towards their closed configuration.

In another embodiment the hinge means connect the first and second jaws in their longitudinal end area constituting a hinged hair slide.

Other objects, features and advantages of the present invention will emerge from the following description of particular embodiments given with reference to the accompanying drawings.

DETAILED DESCRIPTION OF THE PREFERRED EMBODIMENT

Figure 1:
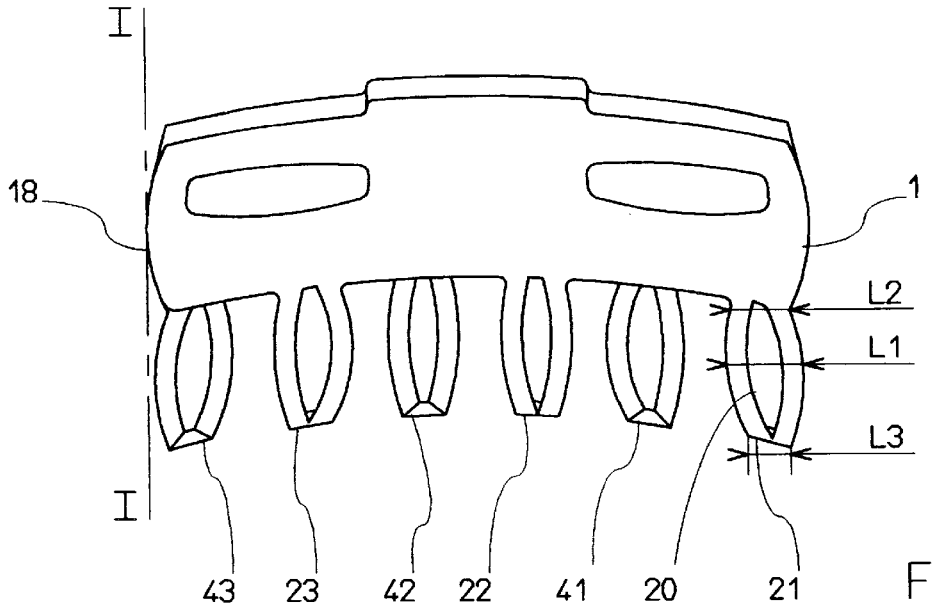
FIG. 1 is a front view of a hair clip constituting one embodiment of the present invention.

In the embodiment shown in FIGS. 1 through 5 the hair clip of the invention comprises a first jaw 1 having a first series of generally parallel curved teeth 21, 22, 23 and a second jaw 3 having a second series of generally parallel curved teeth 41, 42, 43. The teeth of each series of teeth are curved with their concave side facing towards the other series of teeth. Hinge means 5 connect the first jaw 1 and the second jaw 3 allowing them to pivot relative to each other about a hinge pin 6 between an open configuration shown in FIG. 4 in which the first series of teeth 21–23 and the second series of teeth 41–43 are moved apart and a closed configuration shown in FIGS. 1 through 3 in which the two series of teeth 21–23 and 41–43 are interleaved with each other.

In the embodiment shown, constituting a hair clip, the hinge means 5 connect the first and second jaws 1 and 3 in their respective intermediate areas 7 and 8 situated between two respective holding levers 9 and 10 and two respective clamping areas 11 and 12. In this case, the jaws 1 and 3 can have an elongate shape parallel to the hinge pin 6, as shown in the figures, although clips with shorter jaws would also fall within the scope of the present invention.

Figure 2:
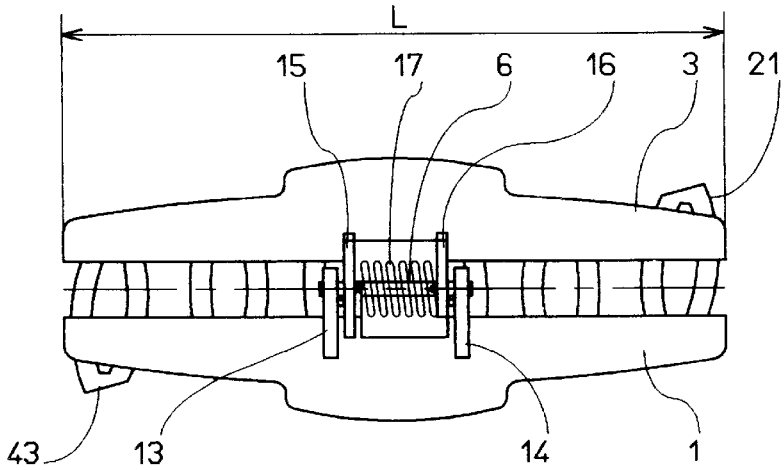
FIG. 2 is a top view of the clip from FIG. 1.
Figure 4:
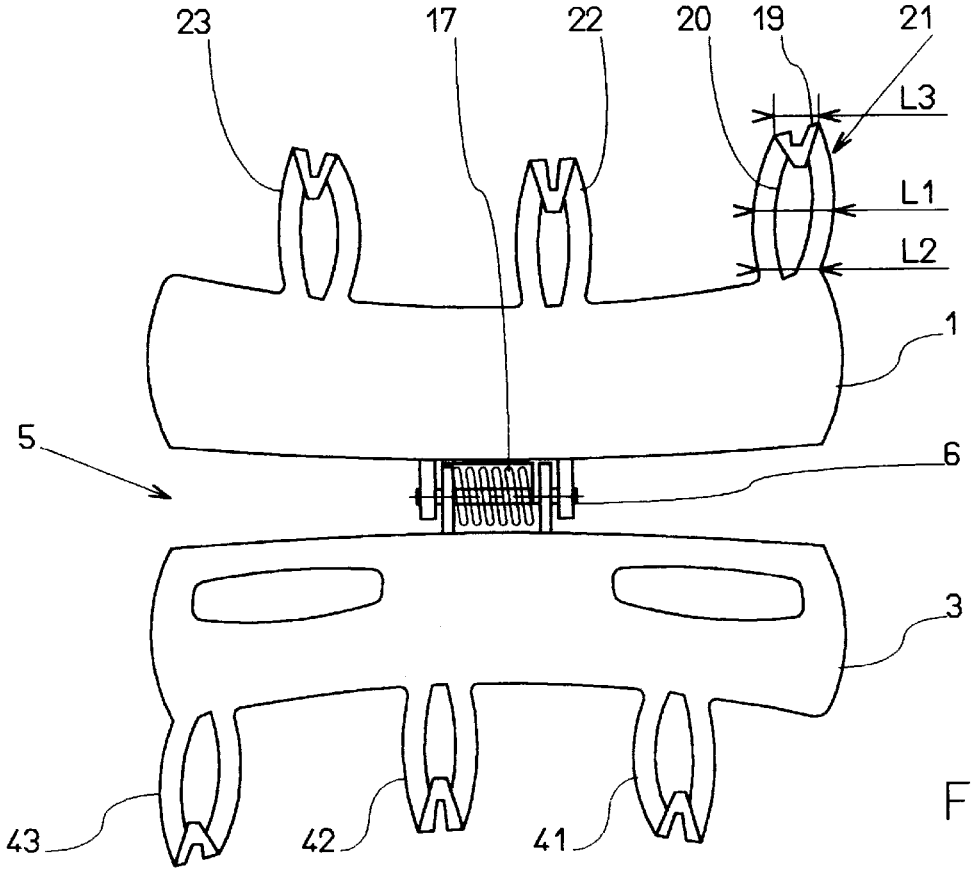
FIG. 4 is a bottom view of the clip from FIG. 1 when open.

In the embodiment shown the hinge means, seen more clearly in FIGS. 2 and 4, comprise two end perforated lugs 13 and 14 on the first jaw 1 and two internal perforated lugs 15 and 16 on the second jaw 3 respectively projecting from the first intermediate connecting area 7 and the second intermediate connecting area 8. The hinge pin 6 passes through the perforations in the four lugs to connect them and form the hinge means 5.

Spring means urge the jaws 1 and 3 to pivot relative to each other towards their closed configuration. The spring means can comprise a coil spring 17 wound in a helix about the hinge pin 6, for example, with its ends bearing on the lever 9 and on the lever 10 of the jaws 1 and 3, respectively.

In accordance with the invention, at least some teeth of the first series of teeth 21–23 and/or at least some teeth of the second series of teeth 41–43 are narrow near their base. For example, at least some of the teeth have a maximal width in the central area of the tooth, their width decreasing in the direction of the base of the tooth and in the direction of the free end of the tooth.

In the embodiment shown in the figures all the teeth have a shape of this kind, narrow in the vicinity of their base and with a maximal width in the central area.

Because the teeth are relatively narrow in the vicinity of their base, the gaps between the teeth of the first jaw in the vicinity of the their base are relatively wide. When the clip is fitted into the hair, a lock of hair tends to be pushed by a tooth of the interleaved opposite other jaw through the relatively wide gap between two teeth of the first jaw and to engage in the corner formed by the progressive narrowing of the teeth in their median area, which has the effect of wedging the lock of hair. This assures improved retention of the clip in the hair.

The tooth 21 will now be described with particular reference to FIGS. 1 and 4, the other teeth having identical or similar shapes.

Figure 3:
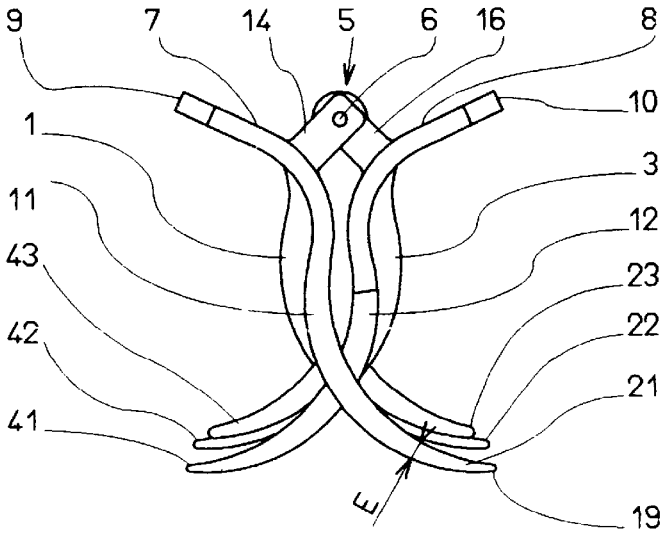
FIG. 3 is a righthand side view of the clip from FIG. 1 when closed.

The tooth 21 has a circular arc shape curved end portion extending towards the opposite teeth, as can be seen in the side view of FIG. 3, and has a maximal width L1 in the central area of the tooth 21, as can be seen in the front view of FIGS. 1 and 4, the width decreasing to a small width L2 in the vicinity of the base of the tooth and decreasing to a small width L3 in the direction of the free end 19 of the tooth. At the same time, the thickness E of the tooth, that is its dimension in the direction perpendicular to the length and to the width L of the teeth, is very much less than their width. For example, at least some of the teeth have at their base and in the vicinity of their free end 19 a width L2 or L3 equal to at least three times their thickness E and a width L1 in the central area equal to at least four times their thickness E. The teeth therefore have a flattened shape with a substantially rectangular cross-section the longer side of which extends in the direction of the width of the tooth and the shorter side of which extends in the direction of the thickness of the tooth.

In its base area, that is to say in the portion of its length near its base where it joins to the body of the jaw, and in the closed configuration of the clip, the tooth 21 can advantageously be oriented to extend away from the other jaw. This further reinforces the effect of wedging of the lock of hair in the wide gap near the base of the teeth.

In the example shown in the drawings the teeth have a median plane of longitudinal symmetry substantially perpendicular to the hinge pin 6.

In the advantageous embodiment shown in the figures the teeth of varying width such as the tooth 21 have a median longitudinal slot 20 which is beneficial in terms of hold and reduces the weight of the clip.

In the closed configuration of the clip shown in FIGS. 1 through 3 the varying width teeth of the first series of teeth 21–23 are preferably side-by-side with the varying width teeth of the second series of teeth 41–43 in their respective central areas. This further improves the hold and the retention of the hair.

In all cases it is advantageous for the teeth to have regularly curved profiles and an end area that is sufficiently tapered and oriented in a direction close to the tangential direction of pivoting of the clip jaw to assure effective penetration of the end area into the hair.

In another embodiment the hinge means connect the first jaw 1 and the second jaw 3 in a longitudinal end area 18 shown in FIG. 1, allowing the jaws 1 and 3 to pivot relative to each other about a hinge axis I—I. This produces a hair slide with profiled teeth.

In both cases a hairdressing item can be produced assuring effective retention in the hair with three teeth on each jaw, for example, as shown in the figures. In this case the jaws can have a length L in the longitudinal direction, that is the direction parallel to the hinge pin 6 in the embodiment shown in the figures, in the range approximately 9 cm to approximately 10 cm, the teeth 21–23 and 41–43 having a maximal width L1 equal to approximately 12 mm and a minimal width L2 at the base equal to approximately 10 mm, their thickness E being approximately 3 mm.

Figure 5:
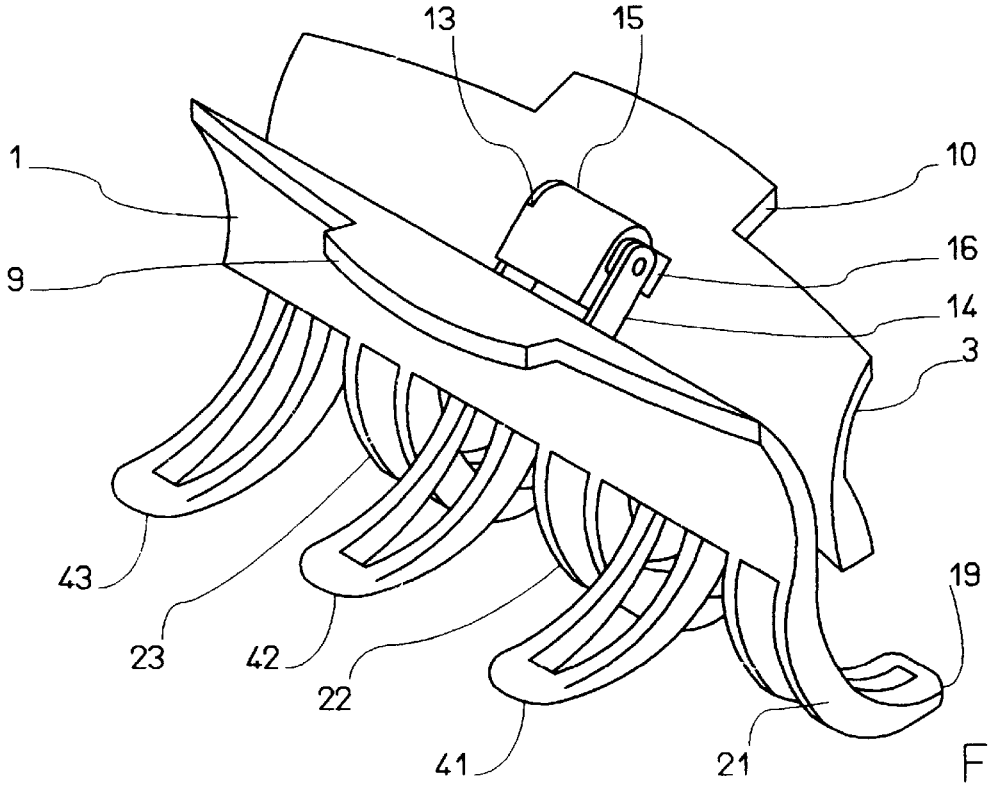
FIG. 5 is a perspective view of the clip from FIG. 1.

In the embodiment shown more particularly in FIGS. 3 and 5, the levers 9 and 10 are steeply inclined to the clamp areas 11 and 12 constituting the main part of the jaws 1 and 3. This inclination significantly increases the opening capacity of the clip, allowing it to hold a greater quantity of hair.

The present invention is not limited to the embodiment explicitly described but encompasses variations and generalizations thereof within the scope of the following claims.

There is claimed:

1. A hair clip comprising a first jaw having a first series of generally parallel curved teeth, a second jaw having a second series of generally parallel curved teeth and hinge means connecting said first jaw and said second jaw allowing them to pivot relative to each other about a hinge pin between an open configuration in which said first series of teeth and said second series of teeth are moved apart and a closed configuration in which said teeth of said first series of teeth are interleaved with said teeth of said second series of teeth, said first series of teeth not touching said second series of teeth in said closed configuration, wherein at least some of said teeth of said first series of teeth or of said second series of teeth (a) have a narrow width in the vicinity of their base to form a wide gap between adjacent teeth, and (b) have a maximal width in the central area, such that said gap progressively narrows toward the central area, but is sufficiently wide at the central area to receive an opposing tooth in the closed configuration without modifying said maximal width, wherein when said clip is fitted into hair, the opposed tooth pushes a lock of hair from the central area toward a corner of the base for improved retention of the clip in the hair.

2. The hair clip claimed in claim 1 wherein at least some of said teeth have a maximal width in the central area of said tooth and their width decreases in the direction of said base of said tooth and in the direction of a free end of said tooth.

3. The hair clip claimed in claim 2 wherein at least some of said teeth have a width at their base and in the vicinity of their free end equal to at least three times their thickness and a width in their central area equal to at least four times their thickness.

4. The hair clip claimed in claim 1 wherein said teeth have a curved longitudinal profile with a base area extending away from the other jaw and an end area extending towards the other jaw in a closed configuration of said clip.

5. The hair clip claimed in claim 1 wherein said varying width teeth have a median longitudinal slot.

6. The hair clip claimed in claim 1 wherein said varying width teeth of said first series of teeth are side-by-side with said varying width teeth of said second series of teeth in their central areas in a closed configuration of said clip.

7. The hair clip claimed in claim 1 wherein said hinge means connect said first jaw and said second jaw in their respective intermediate areas between two holding levers and clamping areas with said first series of teeth and said second series of teeth constituting a hair clip with profiled teeth, and spring means urge said jaws to pivot relative to each other towards their closed configuration.

8. The hair clip claimed in claim 1 wherein said hinge means connect said first and second jaws in their longitudinal end area constituting a hair slide with profiled teeth.

9. The hair clip claimed in claim 7 wherein each jaw has three teeth.

10. The hair clip claimed in claim 7 wherein said jaws have a length in the range approximately 9 cm to 10 cm and said teeth have a maximal width equal to approximately 12 mm, a minimal width at their base equal to approximately 10 mm and a thickness equal to approximately 3 mm.

* * * * *

UNITED STATES PATENT AND TRADE MARK OFFICE

CERTIFICATE OF CORRECTION

PATENT NO. : 5,979,467
DATED : Nov. 9, 1999
INVENTOR(S) : Potut et al.

It is certified that error appears in the above-identified patent and that said Letters Patent is hereby corrected as shown below:

ON THE TITLE PAGE:

[56] References Cited
U.S. PATENT DOCUMENTS
"5,697,288" should read --5,697,388--.

Signed and Sealed this

Twenty-ninth Day of August, 2000

*Attest:*

*Attesting Officer*

Q. TODD DICKINSON

*Director of Patents and Trademarks*

UNITED STATES PATENT AND TRADEMARK OFFICE

CERTIFICATE OF CORRECTION

PATENT NO. : 5,979,467
DATED : November 9, 1999
INVENTOR(S) : Potut et al.

It is certified that error appears in the above-identified patent and that said Letters Patent is hereby corrected as shown below:

Title page,
Item [73], Assignee: should read -- C.S.P. Diffusion, Societe Anonyme, Arbent, France --

Signed and Sealed this

Seventh Day of January, 2003

JAMES E. ROGAN
*Director of the United States Patent and Trademark Office*